US007499662B2

(12) United States Patent
Fuwazaki et al.

(10) Patent No.: US 7,499,662 B2
(45) Date of Patent: Mar. 3, 2009

(54) DEVELOPING APPARATUS, PROCESS CARTRIDGE AND IMAGE FORMING APPARATUS HAVING TONER LEAKAGE PREVENTION MEMBER

(75) Inventors: Takeshi Fuwazaki, Aichi-ken (JP); Fumikazu Sato, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 32 days.

(21) Appl. No.: 11/931,414

(22) Filed: Oct. 31, 2007

(65) Prior Publication Data

US 2008/0080889 A1 Apr. 3, 2008

Related U.S. Application Data

(63) Continuation of application No. 11/190,018, filed on Jul. 27, 2005, now Pat. No. 7,352,981.

(30) Foreign Application Priority Data

Jul. 29, 2004 (JP) ..... P2004-222539

(51) Int. Cl.
*G03G 15/08* (2006.01)

(52) U.S. Cl. ..... 399/103

(58) Field of Classification Search ..... 399/103, 399/105

See application file for complete search history.

(56) References Cited

U.S. PATENT DOCUMENTS 6,937,831 B2 8/2005 Kamimura
2003/0123899 A1* 7/2003 Kamimura ..... 399/103

FOREIGN PATENT DOCUMENTS

| | | |
|---|---|---|
| JP | 63146074 | 6/1988 |
| JP | 2302770 | 12/1990 |
| JP | 11327294 A | 11/1999 |
| JP | 2001194905 | 7/2001 |
| JP | 2003195630 | 7/2003 |

OTHER PUBLICATIONS

JP Office Action, Japanese Patent Application No. 2004-222539.

* cited by examiner

*Primary Examiner*—David M Gray
*Assistant Examiner*—Ruth N Labombard
(74) *Attorney, Agent, or Firm*—Banner & Witcoff, Ltd

(57) ABSTRACT

The sponge sealing member of the side seal is arranged on the roller opposed face of the seal arrangement portion so that the lower end face at the upstream side in the rotating direction of the developing roller is positioned to have the same face as the back end face of the seal arrangement portion and the upper end face at the downstream side is connected with the lower end face of the side portion of the blade back seal. The felt sealing member is arranged so that the upper end portion at the downstream side in the rotating direction of the developing roller is formed astride the lower end portion of the leaf spring member and the sponge sealing member, extends along the sponge sealing member, through the back end face of the seal arrangement portion and around to the lower face of the seal arrangement portion.

8 Claims, 16 Drawing Sheets

DEVELOPING APPARATUS, PROCESS CARTRIDGE AND IMAGE FORMING APPARATUS HAVING TONER LEAKAGE PREVENTION MEMBER

CROSS-REFERENCE TO RELATED APPLICATIONS

This application is a continuation of U.S. application Ser. No. 11/190,018, filed Jul. 27, 2005, which claims priority under 35 U.S.C. §119(a) to Patent Application No. 2004-222539 filed in Japan on Jul. 29, 2004, and the entire contents of these are hereby incorporated by reference.

BACKGROUND

The present invention relates to a developing apparatus, a process cartridge and an image forming apparatus.

In an image forming apparatus such as a laser printer, an electrostatic latent image is formed on the surface of a photoconductor drum and toner is supplied to the electrostatic latent image from a developing apparatus, so that a toner image is retained on the surface of the photoconductor drum. The toner image is then transferred to a paper sheet, so that formation of an image on the paper sheet is achieved.

A developing apparatus comprises: a case having an opening faced to the photoconductor drum; a toner holder, which is blocked out in the case, for holding toner; a developing roller, which is supported at the opening of the case so as to be rotatable, for retaining toner; and a blade for regulating the layer thickness of toner to be retained by the developing roller. A portion of the surface of the developing roller is exposed from the case, and the exposed portion is in contact with and opposed to the surface of the photoconductor drum. Toner held in the toner holder is supplied onto the surface of the developing roller, carried between the blade and the surface of the developing roller with the rotation of the developing roller and retained on the surface of the developing roller as a thin layer having a constant thickness. Toner retained on the surface of the developing roller in such a manner is supplied to the electrostatic latent image formed on the surface of the photoconductor drum when the toner comes in contact with the surface of the photoconductor drum.

Such a developing apparatus is provided with toner sealing members for preventing leakage of toner from the axial end portions of the developing roller. Each of the toner sealing members is constructed by laminating a substrate portion and a felt portion which is to be frictioned with the surface of the developing roller, and is arranged so as to fold back from an opposed face, which is to be opposed to the developing roller, of a curved-face portion formed at each longitudinal end portion of the opening through the point of the curved-face portion to a face of the curved-face portion opposite to the opposed face (see Japanese Patent Application Laid-Open No. 2001-194905, for example).

SUMMARY

However, since the substrate portion of the toner sealing member is made of flexible plastic material and has a thickness in the opposed direction of the substrate portion and the developing roller, it is difficult to move the toner sealing member around from the opposed face of the curved-face portion to the opposite face, and arrangement of the toner sealing member takes a lot of trouble.

On the other hand, when the toner sealing member is not moved around to the opposite face and is arranged only at the edge of the opposed face of the curved-face portion, the toner sealing member flakes away from the opposed face with the rotation of the developing roller.

It is therefore an object to provide: a developing apparatus capable of reducing the trouble of arranging a base and a friction member, preventing flaking of the base from a frame portion and realizing reliable sealing; a process cartridge comprising this developing apparatus; and an image forming apparatus comprising such a developing apparatus or a process cartridge.

In order to achieve the above object, a developing apparatus according to the first aspect is characterized by comprising: a case having a slit-shaped opening; a developer retainer which is arranged along a longitudinal direction of the opening so as to be rotatable in one direction; a frame portion which is located at longitudinal ends of the opening and arranged along a peripheral surface at longitudinal end portions of the developer retainer; a base which has one end portion thereof positioned with respect to an end portion of the frame portion at an upstream side in a rotating direction of the developer retainer and is arranged along an opposed portion of the frame portion to be opposed to the developer retainer; and a friction member which is arranged so as to fold back from above the base through the end portion of the frame portion to a non-opposed portion of the frame portion opposite to the opposed portion and is to be frictioned respectively with longitudinal end portions of the developer retainer.

With such a structure, since the one end portion of the base is positioned with respect to the end portion of the frame portion at the upstream side in the rotating direction of the developer retainer and the base is kept from running round to the non-opposed portion of the frame portion opposite to the opposed portion to be opposed to the developer retainer, it is possible to arrange the base easily and to reduce the trouble of arranging the base. Furthermore, since the base is arranged on the basis of the end portion of the frame portion at the upstream side in the rotating direction of the developer retainer, it is possible to arrange the base on the opposed portion of the frame portion accurately.

Furthermore, since the end portion of the frame portion at the upstream side in the rotating direction of the developer retainer and the one end portion of the base are positioned, no step is formed by the opposed portion of the frame portion and the base, and therefore it is also possible to arrange the friction member easily and to reduce the trouble of arranging the friction member. Moreover, since the friction member is arranged so as to fold back from above the base to the non-opposed portion of the frame portion, it is possible to prevent flaking of the base from the frame portion and to realize reliable sealing.

With the first aspect, it is possible to reduce the trouble of arranging the base and the friction member, to prevent flaking of the base from the frame portion and to realize reliable sealing.

The above and further objects and features will more fully be apparent from the following detailed description with accompanying drawings.

DETAILED DESCRIPTION OF THE EXEMPLARY EMBODIMENTS

Figure 1:
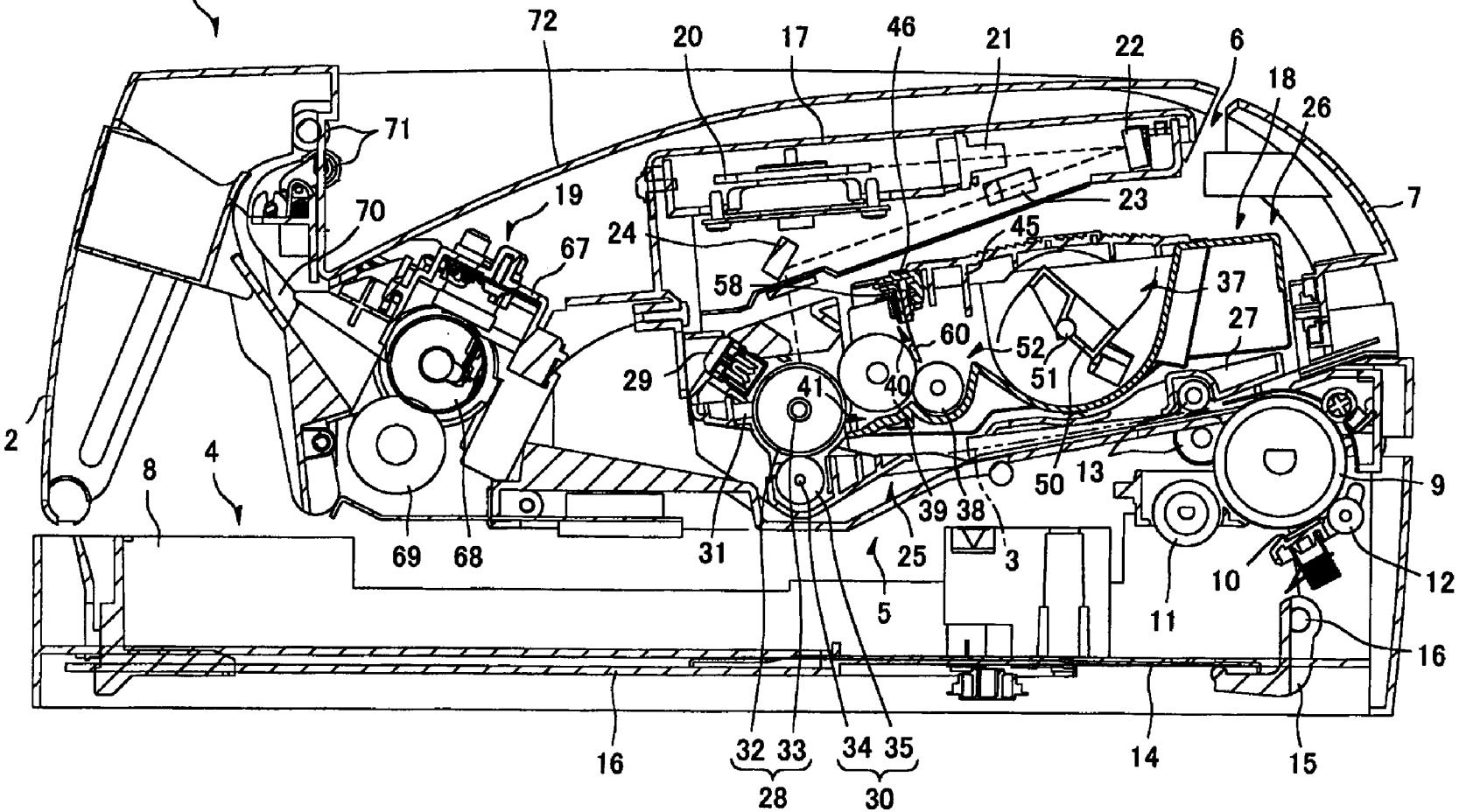
FIG. 1 is an essential part sectional side view showing an embodiment of a laser printer which functions as an image forming apparatus.

FIG. 1 is an essential part sectional side view showing an embodiment of a laser printer which functions as an image forming apparatus. In FIG. 1, the laser printer 1 comprises a feeder unit 4 for feeding a paper sheet 3, an image forming unit 5 for forming an image on a fed paper sheet 3, and the like in a body casing 2.

On one sidewall of the body casing 2, an insertion port 6 for attaching and detaching a later-described process cartridge 18 is formed and a front cover 7 for opening and closing the insertion port 6 is provided. This front cover 7 is supported by a cover shaft, which is inserted into a lower end portion thereof and is not illustrated in the figure, so as to be freely rotatable. Thus, the insertion port 6 is closed by the front cover 7 when the front cover 7 is closed around the covering shaft as the center, while the insertion port 6 is opened when the front cover 7 is opened (tilted) around the covering shaft as the supporting point, so that the process cartridge 18 can be attached to or detached from the body casing 2 through this insertion port 6. Moreover, an operation panel, which comprises operation keys and an LED display unit and is not illustrated in the figure, is embedded in the front cover 7.

It should be noted that a side of this laser printer 1 where the front cover 7 is provided will be hereinafter referred to as "front side" and the opposite side will be referred to as "back side".

The feeder unit 4 comprises: a paper feed tray 8 to be mounted detachably at the bottom portion of the body casing 2; a paper feed roller 9 and a paper feed pad 10 provided above a front end portion of the paper feed tray 8; a pickup roller 11 provided behind the paper feed roller 9; a pinch roller 12 arranged opposite below the front side of the paper feed roller 9; and a resist roller 13 provided above the back side of the paper feed roller 9.

A paper pressing plate 14 is provided inside the paper feed tray 8 so that paper sheets 3 can be laid thereon in a laminated manner. This paper pressing plate 14 is supported at the back end portion thereof so as to swing, so that the front end portion can be moved in the vertical direction.

Moreover, the front end portion of the paper feed tray 8 is provided with a lever 15 for lifting the front end portion of the paper pressing plate 14 upward. This lever 15 is formed to have a substantially L-shaped section so as to go round from the front side to the lower side of the paper pressing plate 14, and the upper end portion thereof is attached to a lever shaft 16 provided at the front end portion of the paper feed tray 8 and the back end portion thereof is in contact with the front end portion of the lower surface of the paper pressing plate 14. Thus, when rotational driving force in the clockwise direction in the figure is inputted to the lever shaft 16, the lever 15 is rotated around the lever shaft 16 as the supporting point and the back end portion of the lever 15 lifts the front end portion of the paper pressing plate 14.

When the front end portion of the paper pressing plate 14 is lifted, the top paper sheet 3 on the paper pressing plate 14 is pressed by the pickup roller 11 and starts to be carried toward the space between the paper feed roller 9 and the paper feed pad 10 by the rotation of the pickup roller 11.

On the other hand, when the paper feed tray 8 is detached from the body casing 2, the front end portion of the paper pressing plate 14 moves downward by its own weight and is made along the bottom face of the paper feed tray 8. In this state, paper sheets 3 can be laid on the paper pressing plate 14 in a laminated manner.

Paper sheets 3 sent toward the space between the paper feed roller 9 and the paper feed pad 10 by the pickup roller 11 are surely separated into respective sheets and fed when being interposed between the paper feed roller 9 and the paper feed pad 10 by the rotation of the paper feed roller 9. A fed paper sheet 3 is carried between the paper feed roller 9 and the pinch roller 12 to the resist roller 13.

The resist roller 13 is composed of a pair of rollers facing each other, and carries the paper sheet 3 toward a transfer position of the image forming unit 5 (a nip position between a photoconductor drum 28 and a transfer roller 30, which will be explained later, for transferring a toner image on the photoconductor drum 28 to the paper sheet 3) after resist.

The image forming unit 5 comprises a scanner unit 17, the process cartridge 18, a fixing unit 19 and the like.

The scanner unit 17 is provided at the upper portion in the body casing 2, and comprises a laser source which is not illustrated in the figure, a polygon mirror 20 driven to rotate, an fθ lens 21, a reflecting mirror 22, a lens 23, another reflecting mirror 24 and the like. A laser beam based on image data, which is emitted from the laser source, is deflected by the polygon mirror 20 as shown in the chain line and passes the fθ lens 21. The optical path thereof is then folded by the reflecting mirror 22, the laser beam further passes the lens 23, and the optical path is further inflected downward by the reflecting mirror 24, so that the laser beam is irradiated onto the surface of the later-described photoconductor drum 28 of the process cartridge 18 by rapid scanning.

The process cartridge 18 is mounted detachably to the body casing 2 below the scanner unit 17. This process cartridge 18 comprises a drum cartridge 25 and a developing cartridge 26 which is mounted detachably to the drum cartridge 25 as a developing apparatus.

The drum cartridge 25 comprises: the developing cartridge 26 mounted at the front side; and the photoconductor drum 28, a scorotron charger 29, the transfer roller 30 and a cleaning brush 31 provided at the back side thereof, between a pair of side plates 27, which respectively extend in the anteroposterior direction and are arranged opposite to each other in a direction crossing the anteroposterior direction (direction crossing the paper surface of FIG. 1, which will be hereinafter referred to just as "width direction").

The photoconductor drum 28 comprises: a cylindrical drum body 32 having the surface layer formed of a positively-charged photosensitive layer made of polycarbonate or the like; and a drum shaft 33 made of metal, which extends along the longitudinal direction of the drum body 32 at the axis of this drum body 32. The drum shaft 33 is supported at the side plates 27 of the drum cartridge 25 so as not to be rotatable and the drum body 32 is supported so as to be rotatable with respect to this drum shaft 33, so that the photoconductor drum 28 is provided between the side plates 27 so as to be rotatable on the drum shaft 33.

The scorotron charger 29 is arranged opposite to the photoconductor drum 28 at a distance obliquely above the back side of the photoconductor drum 28 so as not to come in contact with the photoconductor drum 28. This scorotron charger 29 is a charger of scorotron type for positive charge which generates corona discharge from a charging wire such as tungsten, and is provided so as to positively charge the surface of the photoconductor drum 28 uniformly.

The transfer roller 30 is supported at the side plates 27 of the drum cartridge 25 so as to be freely rotatable, and is arranged so as to face and come in contact with the photoconductor drum 28 in the vertical direction and to form a nip between the photoconductor drum 28 and the transfer roller 30. This transfer roller 30 is constructed by coating a roller shaft 34 made of metal with a roller 35 made of conductive rubber material. On transfer, transfer bias is applied to the transfer roller 30.

The cleaning brush 31 is arranged behind the photoconductor drum 28 with a point of the brush being in contact with the surface of the drum body 32 of the photoconductor drum 28.

Figure 2:
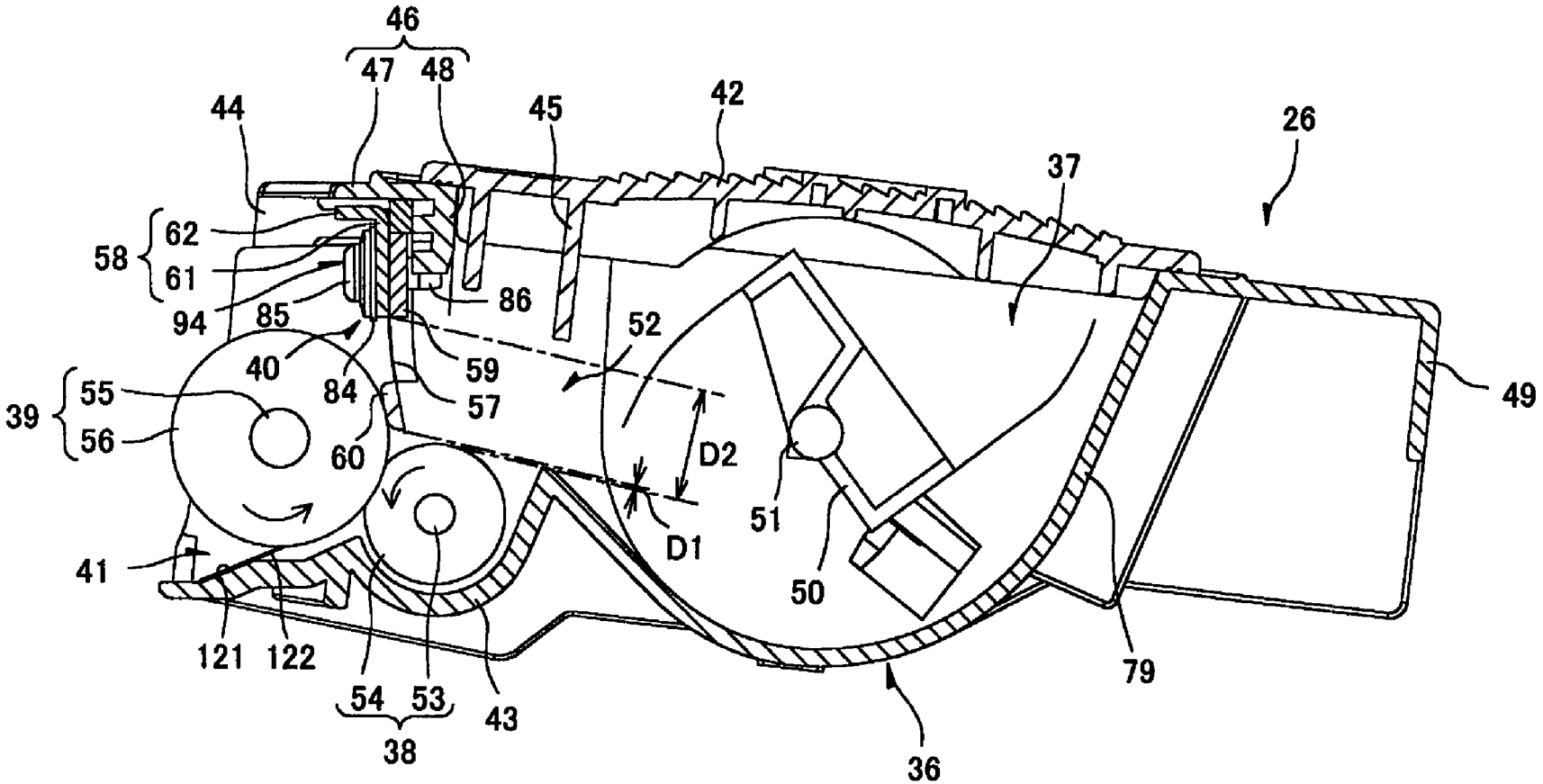
FIG. 2 is a sectional side view of a developing cartridge shown in FIG. 1.

The developing cartridge 26 comprises: a case 36; and a toner holding chamber 37, a feed roller 38, a developing roller 39 as a developer retainer, and a blade unit 40 in this case 36, as shown in FIG. 2.

The case 36 is formed to have a box-like shape which has a slit-shaped opening 41 at the back end portion.

Figure 3:
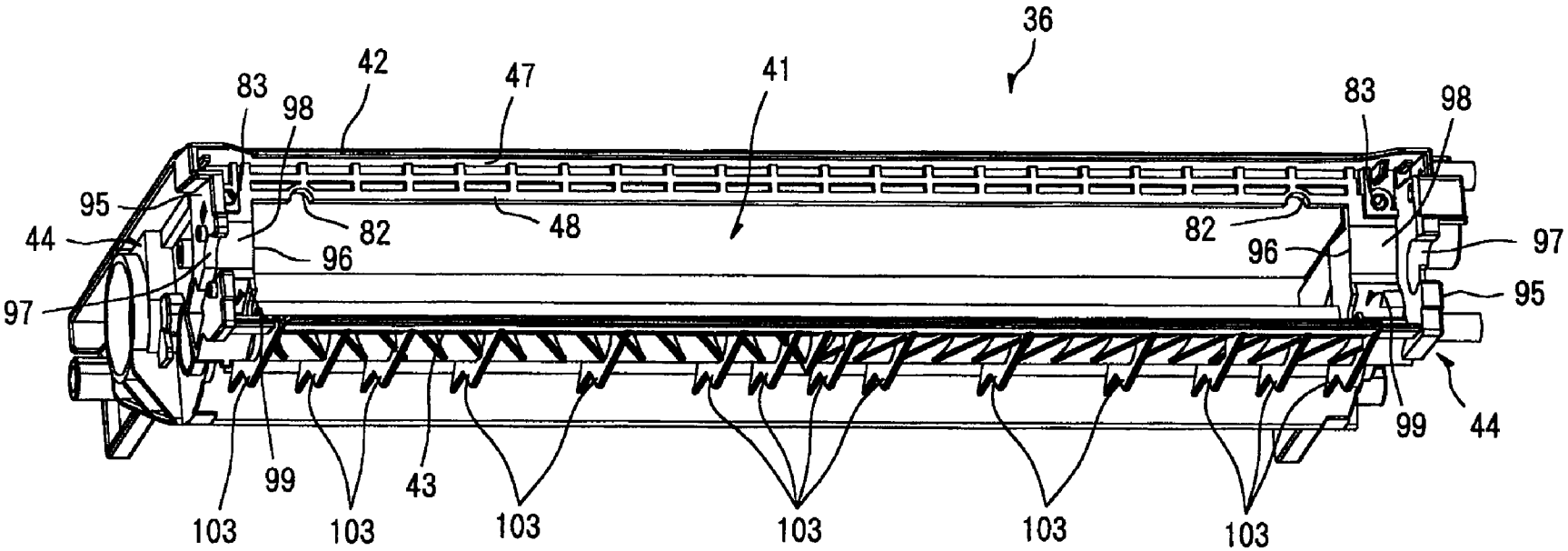
FIG. 3 is a perspective view of a case of the developing cartridge shown in FIG. 2.

In particular, as shown in FIGS. 2 and 3, the case 36 comprises: an upper wall 42 and a lower wall 43 which face each other in the vertical direction; a pair of sidewalls 44 provided so as to close the space between these upper wall 42 and lower wall 43 from both width-direction sides; and a front wall 79 provided so as to close the space between the upper wall 42 and the lower wall 43 from the front side.

The upper wall 42 comprises a partition plate 45 which extends from a middle portion in the anteroposterior direction nearer to the back side toward the lower wall 43 as shown in FIG. 2. This partition plate 45 separates the internal space of the case 36 and the internal space at the front side is blocked out as the toner holding chamber 37. Moreover, a blade attachment unit 46 for attaching the blade unit 40 is provided at the back end portion of the upper wall 42, and the slit-shaped opening 41 which extends in the width direction is blocked out by this blade attachment unit 46, the lower wall 43 and the pair of sidewalls 44.

The blade attachment unit 46 is formed to have an L-shaped side section. In particular, the blade attachment unit 46 comprises: a plate-like upper attachment portion 47, which faces the lower wall 43, extends in the width direction and has a width in the anteroposterior direction; and a front attachment portion 48, which is inflected downward from the front end portion of the upper attachment portion 47, extends in the width direction, has a width in the vertical direction and is provided with a lattice-like recess seen from the backside. This blade attachment unit 46 may be formed separately from the upper wall 42 and fastened to the upper wall 42, or may be formed integrally with the upper wall 42. When the blade attachment unit 46 is formed integrally with the upper wall 42, it is possible to reduce the number of components of this laser printer 1 and to simplify the structure.

At the front attachment portion 48, recesses 82 for preventing collision with later-described assembly screws 94 are formed by notching the lower edge of the longitudinal end portions in a semi-circular shape. Moreover, at the front attachment portion 48, tapped holes 83 for screwing later-described attachment screws 100 on attaching the blade unit 40 to the blade attachment unit 46 (front attachment portion 48) are formed at positions at a distance from the respective recesses 82 outward in the longitudinal direction.

The front end portion of the lower wall 43 extends obliquely upward from the front side and is connected in succession with the front wall 79 as shown in FIG. 2. Moreover, a film arrangement portion 121 which extends along the axial direction of the developing roller 39 is formed at the back upper surface of the lower wall 43. This film arrangement portion 121 is made of polyethylene terephthalate and is provided with a lower film 122 to be frictioned uniformly with the outer surface of a roller 56 of the developing roller 39 along the axial direction thereof. Since the lower film 122 is frictioned uniformly with the outer surface of the roller 56 of the developing roller 39 along the axial direction thereof above the lower wall 43, it is possible to prevent toner leakage from between the lower wall 43 and the developing roller 39. Furthermore, as shown in FIG. 3, a plurality of ribs 103 are formed at the lower surface of the lower wall 43 so as to extend respectively in the anteroposterior direction at a distance in the width direction. The ribs 103 formed at the width-direction end portions of the lower surface of the lower wall 43 extend in the anteroposterior direction along the width-direction internal edge of a lower face 102 of later-described seal arrangement portions 96 and function also as a guide for arranging a later-described felt sealing member 93.

Each of the sidewalls 44 comprises: a support plate portion 95 for supporting the developing roller 39; and the seal arrangement portion 96, which is a frame portion where a side portion 88 of a blade back seal 87 that will be explained later and a side seal 91 are arranged, at the opening 41 as shown in FIG. 3.

The support plate portion 95 is of plate-like shape extending in the vertical direction, and is provided with a bearing hole 97 for bearing a roller shaft 55 of the developing roller 39, which will be explained later. This bearing hole 97 is of U shape seen from a side and is provided with an opening at the back end portion, so that the roller shaft 55 of the developing roller 39 can be taken in through the opening.

The seal arrangement portion 96 is provided adjacent to the longitudinal inside of the opening 41 with respect to the support plate portion 95, and has a roller opposed face 98 which faces the axial end portion of the roller 56 of the developing roller 39, which will be explained later, and is formed as one surface extending in an inflected manner along the outer surface of the roller 56. Moreover, a recess 99 for taking in a roller shaft 53 of the feed roller 38, which will be explained later, is formed in the vertically middle of the seal arrangement portion 96 so as to sink in obliquely forward.

Moreover, as shown in FIG. 2, the front wall 79 is provided with a handle 49, which extends forward from the connected portion with the upper wall 42 and is further folded downward, to be gripped in order to attach and detach the developing cartridge 26 to and from the drum cartridge 25.

In the toner holding chamber 37, toner of a positively-charged non-magnetic first component is held as developer. Used as the toner is polymer toner obtained by copolymerizing polymerizable monomer, e.g. styrene monomer such as styrene or acrylic monomer such as acrylic acid, alkyl (C1-C4) acrylate or alkyl (C1-C4) methacrylate, by a known polymerization method such as suspension polymerization. Such polymer toner is of spherical shape and has extremely favorable fluidity, and it is possible to achieve high-quality image formation.

It should be noted that coloring agent or wax etc. such as carbon black is compounded in such toner and addition agent such as silica is added in order to enhance the fluidity. The particle diameter thereof is approximately 6-10 μm.

Moreover, an agitator 50 for stirring toner in the toner holding chamber 37 is provided in the toner holding chamber 37. The agitator 50 is supported at a rotating shaft 51, which extends in the width direction, at a center portion of the toner holding chamber 37, and toner in the toner holding chamber 37 is stirred and discharged backward from a communication port 52 between the partition plate 45 and the lower wall 43 when the agitator 50 is rotated on the rotating shaft 51 as the supporting point.

The feed roller 38 is arranged obliquely below the back side of the communication port 52 and is supported between the pair of sidewalls 44 of the case 36 so as to be rotatable. This feed roller 38 is constructed by coating the roller shaft 53 made of metal with a roller 54 made of conductive foamed material.

The developing roller 39 is arranged along the width direction at the opening 41 behind the feed roller 38 and is supported between the support plate portions 95 of the pair of sidewalls 44 of the case 36 so as to be rotatable. Moreover, the developing roller 39 faces and comes in contact with the photoconductor drum 28 in the anteroposterior direction with a portion of the surface thereof being arranged so as to be projected and exposed backward from the opening 41 of the case 36 and with the developing cartridge 26 being mounted to the drum cartridge 25. This developing roller 39 is constructed by coating the roller shaft 55 made of metal with the roller 56 made of conductive rubber material. The roller 56 of the developing roller 39 is provided with the surface of a roller layer made of conductive polyurethane rubber or silicone rubber including carbon fine particles etc., which is coated with a coat layer made of polyurethane rubber or silicone rubber including fluorine. Moreover, the roller 56 of the developing roller 39 is arranged and come in contact with the roller 54 of the feed roller 38 so as to be compressed by each other.

The feed roller 38 is rotated in the counterclockwise direction so that a portion to come in contact with the developing roller 39 is rotated from above to below as shown by the arrow. The developing roller 39 is rotated in the counterclockwise direction so that a portion to be exposed from the case 36 is rotated from above to below as shown by the arrow.

The blade unit 40 comprises: the leaf spring member 57; the bend preventing member 58 and a reinforcing plate 59 for supporting the leaf spring member 57; two assembly screws 94 for fastening them to each other; and seal washers 84, as shown in FIGS. 4 to 7. As described later, this blade unit 40 is attached to the blade attachment unit 46 so that the reinforcing plate 59 faces and comes in contact with the front attachment portion 48 with the leaf spring member 57 being interposed between the bend preventing member 58 and the reinforcing plate 59.

The leaf spring member 57 is made of thin leaf spring material of metal and is formed to have a rectangular shape having substantially the same width as the axial width of the roller 56 of the developing roller 39. The upper end portion of this leaf spring member 57 is interposed between the bend preventing member 58 and the reinforcing plate 59. Moreover, a pressing member 60 having a rectangular section made of insulating silicone rubber is formed at the lower end portion of the leaf spring member 57 so as to extend in the longitudinal direction of the leaf spring member 57. It should be noted that pressing member 60 is not provided at the longitudinal end portions of the leaf spring member 57, so that the upper end portion of the later-described felt sealing member 93 can be applied to the longitudinal end portion of the leaf spring member 57.

It should be noted that the longitudinal end portions of the leaf spring member 57 are provided with insertion holes (which are not illustrated in the figure), through which the respective assembly screws 94 are inserted, formed at positions facing later-described thread groove holes 80 in the anteroposterior direction so as to run through the thickness direction. Each of the insertion holes is arranged medial to the edges of the pressing member 60 in the longitudinal direction of the leaf spring member 57. Moreover, attachment holes 81 for inserting the later-described attachment screws 100 are formed lateral to the respective insertion holes in the longitudinal direction of the leaf spring member 57 so as to run through the thickness direction. Each of the attachment holes 81 is formed at a position corresponding, in the anteroposterior direction, to each tapped hole 83 formed at the front attachment portion 48 of the blade attachment unit 46.

The bend preventing member 58 has an L-shaped side section, extends in the longitudinal direction of the leaf spring member 57 and is arranged opposite to the upper end portion of the surface of the leaf spring member 57. This bend preventing member 58 integrally comprises: a rectangular plate-like contact portion 61 to come in contact with the surface of the leaf spring member 57; an extended portion 62 which functions as a reinforcing portion extending backward from the upper edge of the contact portion 61 in a state where the blade unit 40 is attached to the blade attachment unit 46; and two grippers 63 extending downward from the back end portion (free end portion in the extension direction) of the extended portion 62.

The extended portion 62 comprises: end extended parts 64 having a first width, which extend from the longitudinal end portions of the upper edge of the contact portion 61; and a central extended part 65 which is provided between these end extended parts 64, has a second width wider than the first width, and extends from the longitudinal center portion of the upper edge of the contact portion 61. In other words, the extended portion 62 extends backward from the longitudinal entire area of the upper edge of the contact portion 61 and has notch portions 66 at the longitudinal end portions thereof.

The two grippers 63 respectively extend obliquely backward and downward with respect to the central extended part 65 from the longitudinal end portions of the central extended part 65 and are formed to have a rectangular shape seen from the backside.

It should be noted that insertion holes (which are not illustrated in the figure) to which the respective assembly screws 94 are inserted are formed to run through the thickness direction at positions of the longitudinal end portions of the contact portion 61, which are located below the respective end extended parts 64 and are opposed to the later-described thread groove holes 80 in the anteroposterior direction. Moreover, attachment holes 81 corresponding to the respective attachment holes 81 of the leaf spring member 57 are formed to run through the thickness direction lateral to the respective insertion holes in the longitudinal direction of the contact portion 61.

The reinforcing plate 59 is made of an elongated rectangular metal plate, extends along the longitudinal direction of the leaf spring member 57 and is formed to be shorter than the interval between the attachment holes 81 of the leaf spring member 57. This reinforcing plate 59 is arranged at a position of the backside of the leaf spring member 57, which faces the contact portion 61 of the bend preventing member 58 with the leaf spring member 57 being interposed therebetween, so that the lower surface thereof has the same face in the vertical direction as the lower surface of the contact portion 61. Moreover, the reinforcing plate 59 is formed to have a width slightly narrower than the width (width in the vertical direction) of the contact portion 61 of the bend preventing member 58. This reinforcing plate 59 supports the upper end portion of the leaf spring member 57 between the bend preventing member 58 and the reinforcing plate 59, so as to further reinforce the leaf spring member 57. Moreover, the thread groove holes 80 to which the respective assembly screws 94 are screwed are formed at the longitudinal end portions of the reinforcing plate 59.

Each of the assembly screws 94 integrally comprises a screw head 85 and a screw shaft 86 which extends from this screw head 85. Each of the assembly screws 94 fastens the bend preventing member 58 and reinforcing plate 59 and the leaf spring member 57 interposed therebetween to each other, by inserting the screw shaft 86 into an insertion hole (which is not illustrated in the figure) formed at each of the longitudinal end portions of the bend preventing member 58 and the leaf spring member 57 from the bend preventing member 58 side with the upper end portion of the leaf spring member 57 being interposed between the bend preventing member 58 and the reinforcing plate 59, and by screwing the screw shaft 86 into the thread groove hole 80 formed at each of the end portions of the reinforcing plate 59 with the screw head 85 facing the contact portion 61.

It should be noted that the leaf spring member 57, the bend preventing member 58 and the reinforcing plate 59 are fastened to each other only by the two assembly screws 94.

Each of the seal washers 84 is made of rubber material and is formed to have an annular plate-like shape to which the screw shaft 86 of the assembly screw 94 can be inserted. In assembling with the assembly screws 94 described above, each of the seal washers 84 is interposed between the screw head 85 of the assembly screw 94 and the contact portion 61 of the bend preventing member 58 by inserting the screw shaft 86 of the assembly screw 94 into the seal washer 84 and then inserting the screw shaft 86 into the bend preventing member 58, the leaf spring member 57 and the reinforcing plate 59. Since the seal washer 84 is interposed, it is possible to seal the space between the screw head 85 of the assembly screw 94 and the contact portion 61 of the bend preventing member 58 and to prevent leakage of toner, which enters between the screw shaft 86 and the thread groove hole 80, from between the screw head 85 and the contact portion 61.

The blade unit 40 is attached to the blade attachment unit 46 so that the extended portion 62 of the bend preventing member 58 faces the upper attachment portion 47 at a distance and the reinforcing plate 59 faces and comes in contact with the front attachment portion 48, as shown in FIG. 2.

Figure 8:
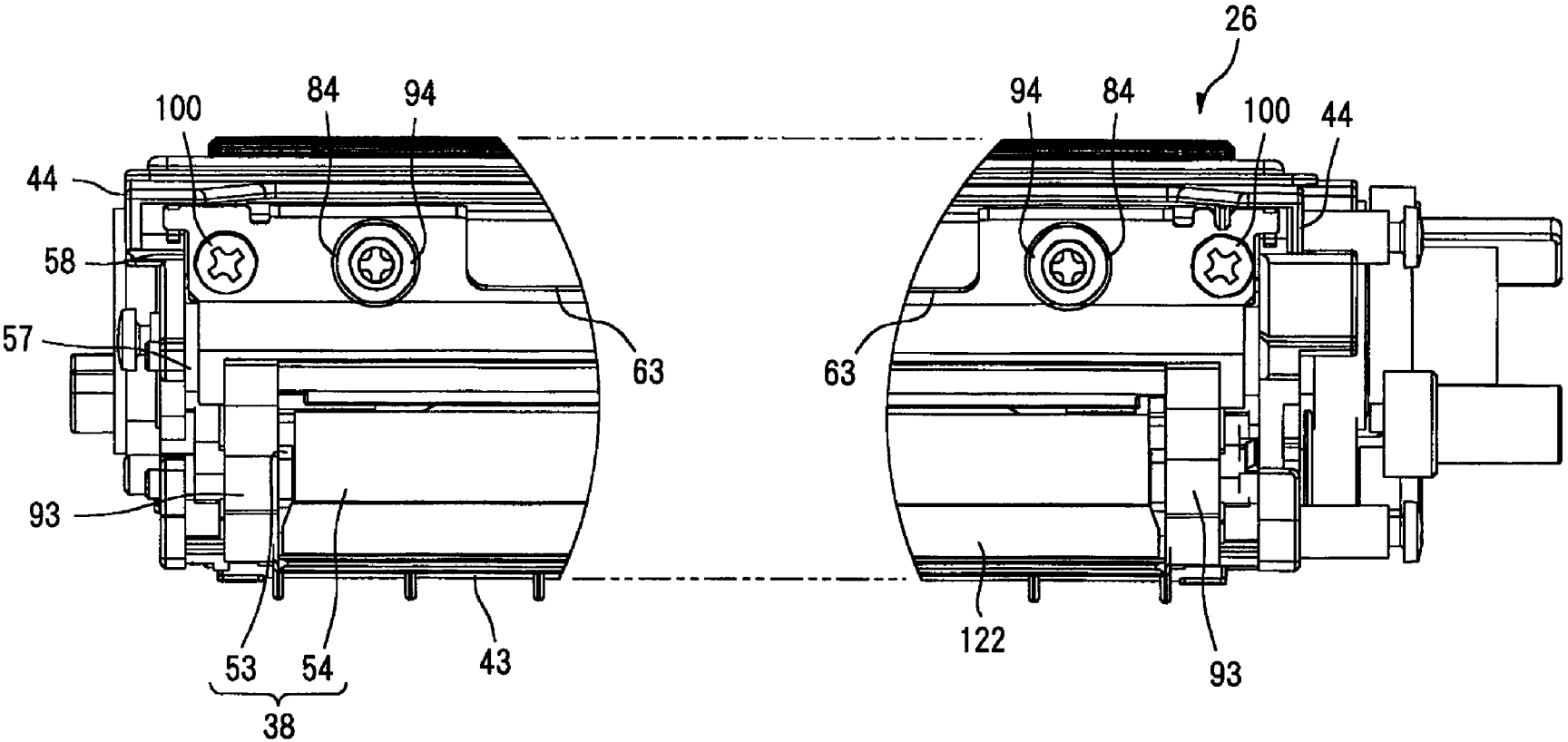
FIG. 8 is a rear view showing the structure of longitudinal end portions of the developing cartridge shown in FIG. 2.

In attachment of this blade unit 40, as shown in FIG. 8, the blade unit 40 is fastened to the blade attachment unit 46 by inserting the attachment screws 100 into the respective attachment holes 81 and screwing the attachment screws 100 into the tapped holes 83 of the blade attachment unit 46.

Figure 4:
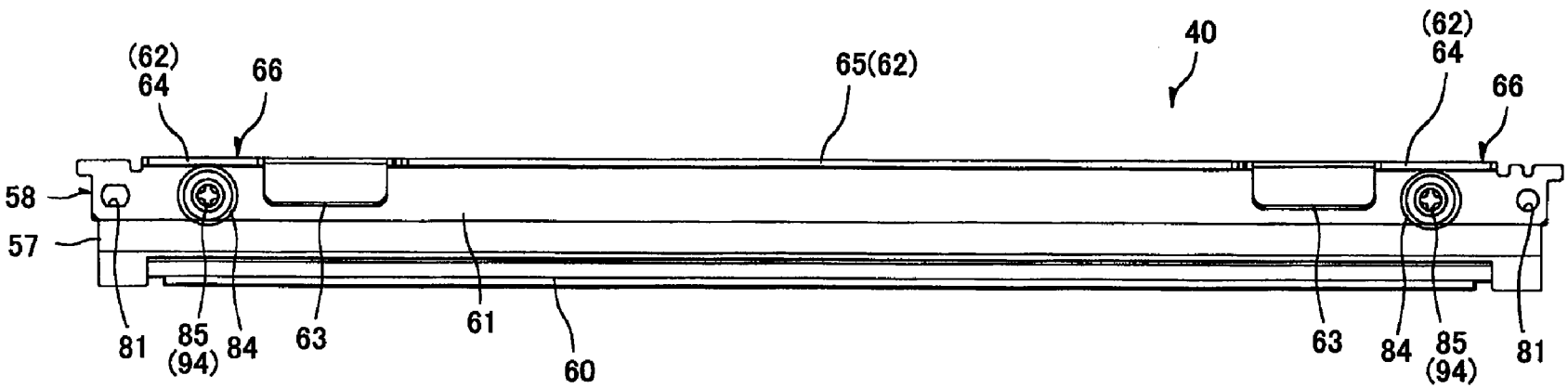
FIG. 4 is a rear view of a blade unit shown in FIG. 2.
Figure 5:
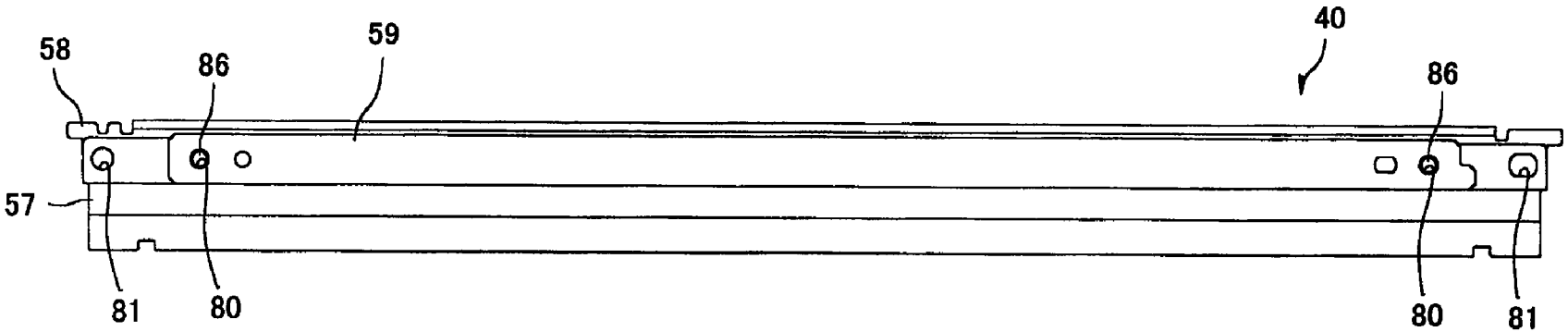
FIG. 5 is a front view of the blade unit shown in FIG. 2.
Figure 6:
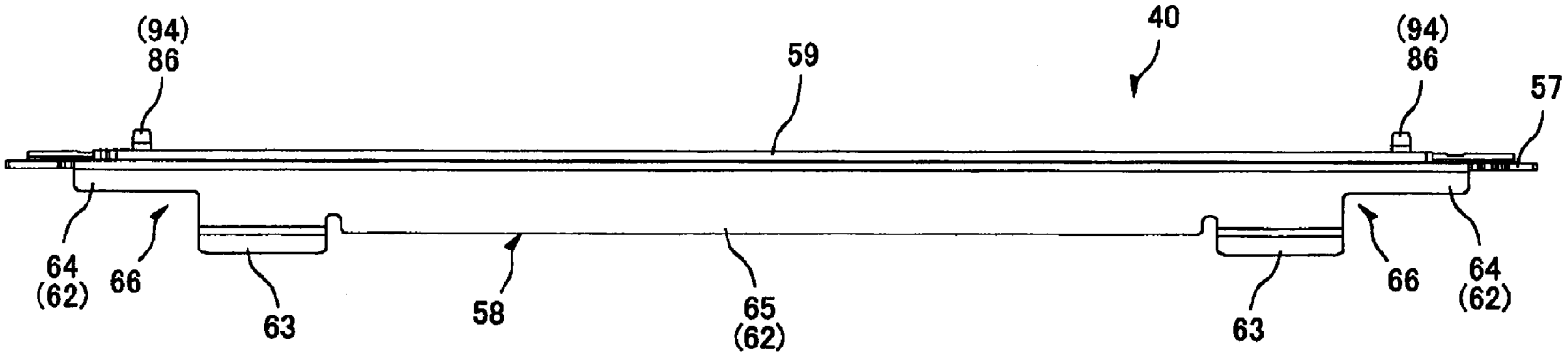
FIG. 6 is a plan view of the blade unit shown in FIG. 2.
Figure 7:
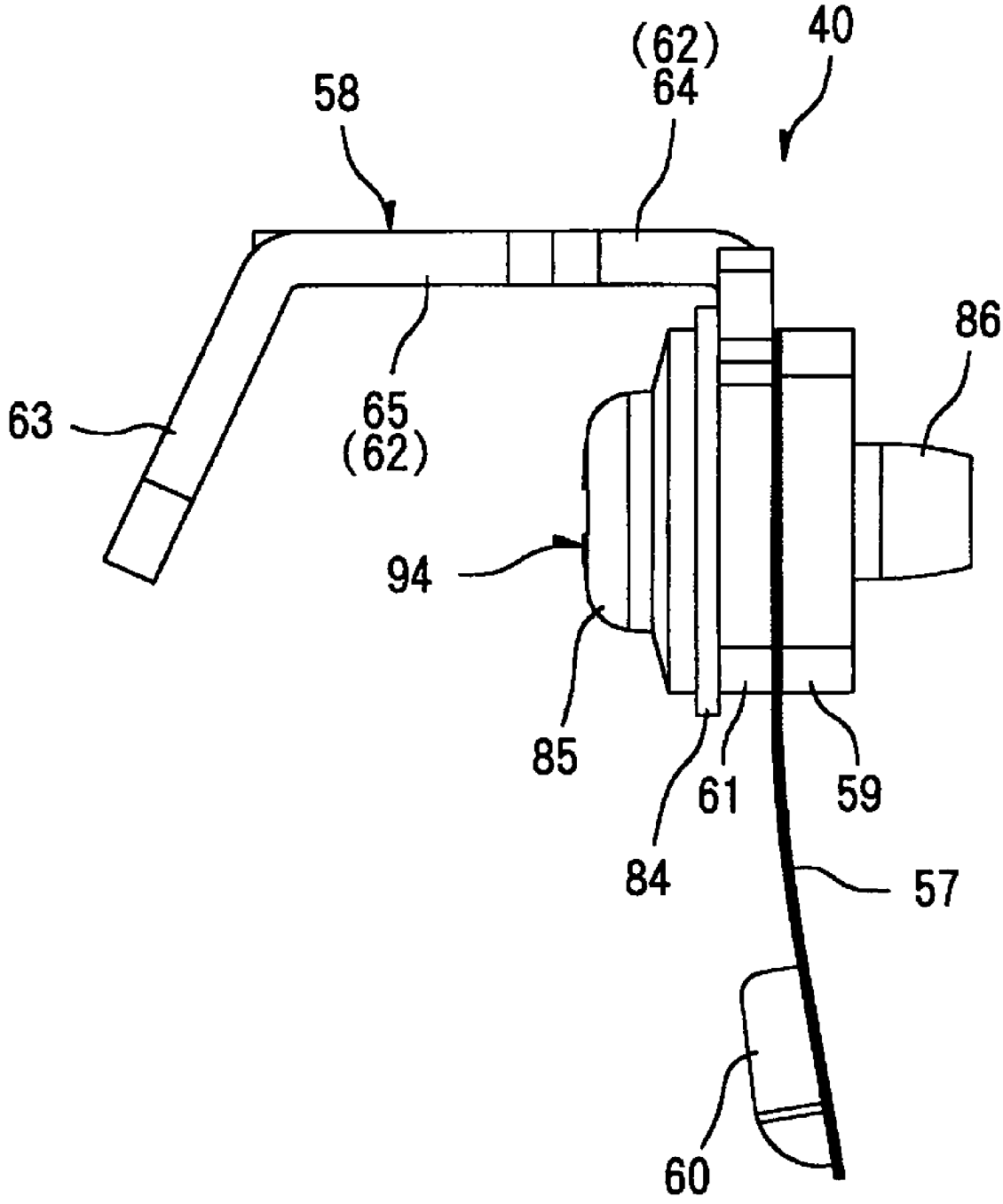
FIG. 7 is a side view of the blade unit shown in FIG. 2.

It should be noted that, of the respective attachment holes 81 of the leaf spring member 57 and the contact portion 61, one attachment hole 81 is formed to be a circular hole corresponding to the major diameter of the screw shaft of the attachment screw 100 and the other attachment hole 81 is formed to be a long hole slightly elongated in the longitudinal direction of the contact portion 61, the leaf spring member 57 and the reinforcing plate 59, as shown in FIGS. 4 and 5. By forming one attachment hole 81 to be a long hole, it is possible to allow a tolerance of the formation position of the attachment hole 81 in the longitudinal direction and to attach the blade unit 40 to the blade attachment unit 46 easily.

Moreover, in attachment of the blade unit 40 to the blade attachment unit 46, since the point portions of the screw shafts 86 of the assembly screws 94 projected from the reinforcing plate 59 enter the recesses 82 of the front attachment portion 48, it is possible to prevent collision between the point portions of the screw shafts 86 and the front attachment portion 48. It is therefore possible to make the reinforcing plate 59 come in contact with the front attachment portion 48 without generation of a clearance.

Furthermore, in attachment of the blade unit 40, since the blade unit 40 can be positioned at the blade attachment unit 46 by gripping the grippers 63 from the notch portions 66, it is possible to attach the blade unit 40 to the blade attachment unit 46 easily.

In a state where the blade unit 40 is attached to the blade attachment unit 46, the lower end portion of the leaf spring member 57 faces the roller 56 of the developing roller 39 from the front side and the pressing member 60 applies pressure welding against the roller 56 by elastic force of the leaf spring member 57.

Toner discharged from the communication port 52 to the back side internal space of the case 36 by the rotation of the agitator 50 is supplied onto the roller 56 of the developing roller 39 by the rotation of the feed roller 38 and, at this time, is positively charged by frictional electrification between the roller 54 of the feed roller 38 and the roller 56 of the developing roller 39. Toner supplied onto the roller 56 of the developing roller 39 enters the space between the pressing member 60 of the blade unit 40 and the roller 56 of the developing roller 39 with the rotation of the developing roller 39, is further discharged by frictional electrification here, forms a thin layer having a constant thickness and is retained on the roller 56 of the developing roller 39.

It should be noted that, regarding this developing cartridge 26, the vertical interval D1 between the lower edge of the leaf spring member 57 and the uppermost position of the roller 54 of the feed roller 38 is shorter than or equal to 2 mm, and it is possible to carry toner charged between the roller 54 of the feed roller 38 and the roller 56 of the developing roller 39 to the position of the pressing member 60 immediately and to eliminate the need for high charge of toner due to such an interval D1. Moreover, the vertical interval D2 between the lower edge of the reinforcing plate 59 and the uppermost position of the roller 54 of the feed roller 38 is longer than or equal to 15 mm, and it is possible to feed toner in the toner holding chamber 37 to the developing roller 39 side smoothly due to such an interval D2.

On the other hand, as shown in FIG. 1, the surface of the photoconductor drum 28 is positively charged uniformly by the scorotron charger 29 and then exposed to light by rapid scanning of a laser beam from the scanner unit 17, so that an electrostatic latent image based on image data is formed.

Next, by the rotation of the developing roller 39, toner which is retained on the developing roller 39 and is positively charged is supplied to an electrostatic latent image formed on the surface of the photoconductor drum 28, i.e. an exposure portion of the surface of the photoconductor drum 28 positively discharged uniformly which is exposed to light by a laser beam and has lowered potential, when facing and coming in contact with the photoconductor drum 28 and is retained selectively, so that image visualization is achieved and therefore a toner image is formed by reversal development.

Then, the photoconductor drum 28 and the transfer roller 30 are driven to rotate so as to convey a paper sheet 3 interposed therebetween and the paper sheet 3 is conveyed between the photoconductor drum 28 and the transfer roller 30, so that a toner image retained on the surface of the photoconductor drum 28 is transferred onto the paper sheet 3.

It should be noted that paper powder attached to the surface of the photoconductor drum 28 by contact with the paper sheet 3 is removed by a brush of the cleaning brush 31 after transferring, when the surface of the photoconductor drum 28 faces the brush with the rotation of the photoconductor drum 28.

The fixing unit 19 is provided behind the process cartridge 18 and comprises a fixing frame 67, and a heating roller 68 and a pressing roller 69 in this fixing frame 67.

The heating roller 68 comprises a metal raw tube and a halogen lump for heating in the metal raw rube and is driven to rotate by input of power from a motor which is not illustrated in the figure.

The pressing roller 69 is arranged opposite below the heating roller 68 so as to press the heating roller 68. This pressing roller 69 is constructed by coating a roller shaft made of metal with a roller made of rubber material and is driven to follow the rotation drive of the heating roller 68.

Toner transferred onto the paper sheet 3 applies heat fusing at the fixing unit 19 when the paper sheet 3 is conveyed between the heating roller 68 and the pressing roller 69. The paper sheet 3 to which toner is fixed is conveyed to a delivery path 70 which extends in the vertical direction toward the upper surface of the body casing 2. The paper sheet 3 conveyed to the delivery path 70 is delivered onto a discharge tray 72 formed on the upper surface of the body casing 2, by a delivery roller 71 provided at the upper end thereof.

Figure 9:
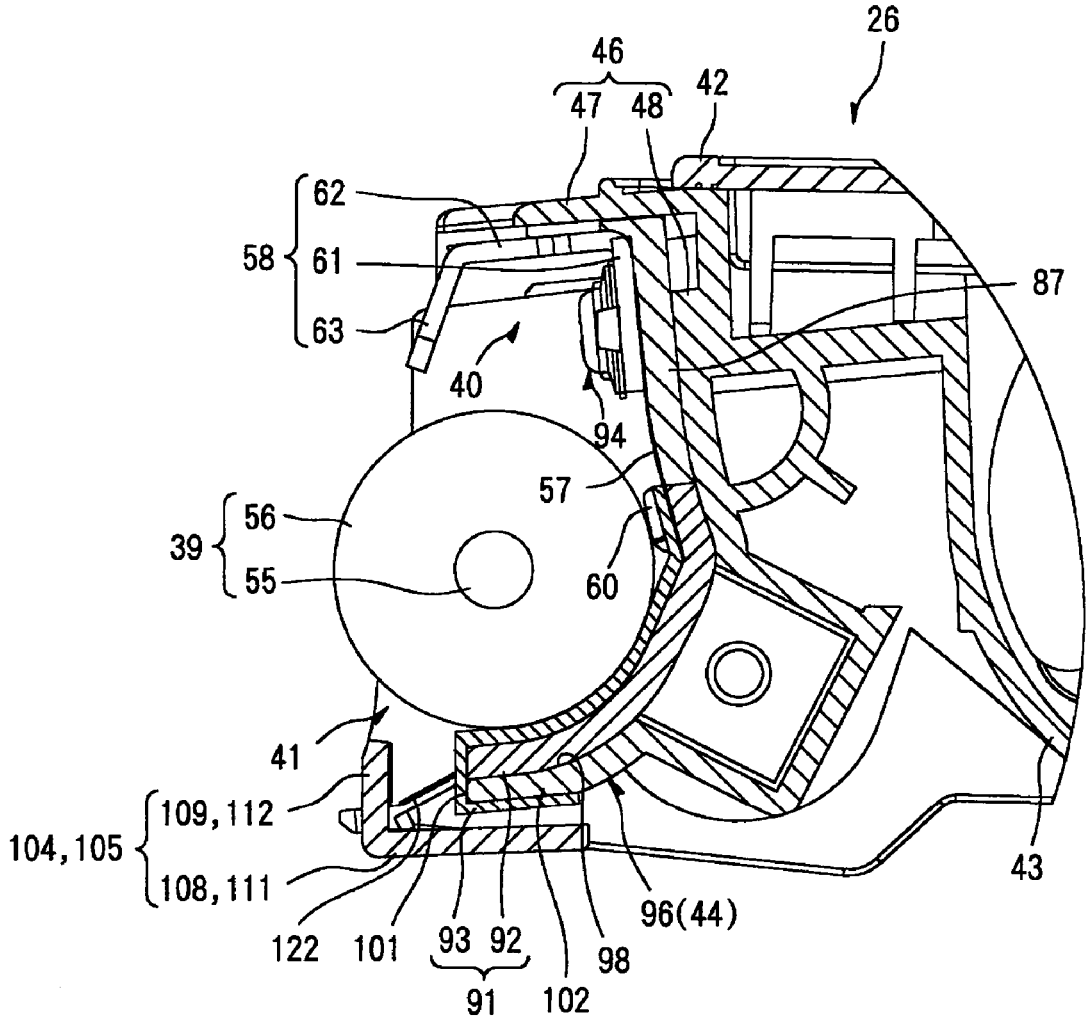
FIG. 9 is a sectional side view showing the structure of an opening of the case of the developing cartridge shown in FIG. 2.

Moreover, at this developing cartridge 26, a blade back seal 87 for sealing the space between the leaf spring member 57 and bend preventing member 58 and the front attachment portion 48 and seal arrangement portion 96 is interposed between the leaf spring member 57 and bend preventing member 58 of the blade unit 40 and the front attachment portion 48 of the blade attachment unit 46 and seal arrangement portions 96 of the respective sidewalls 44, as shown in FIG. 9.

Figure 10:
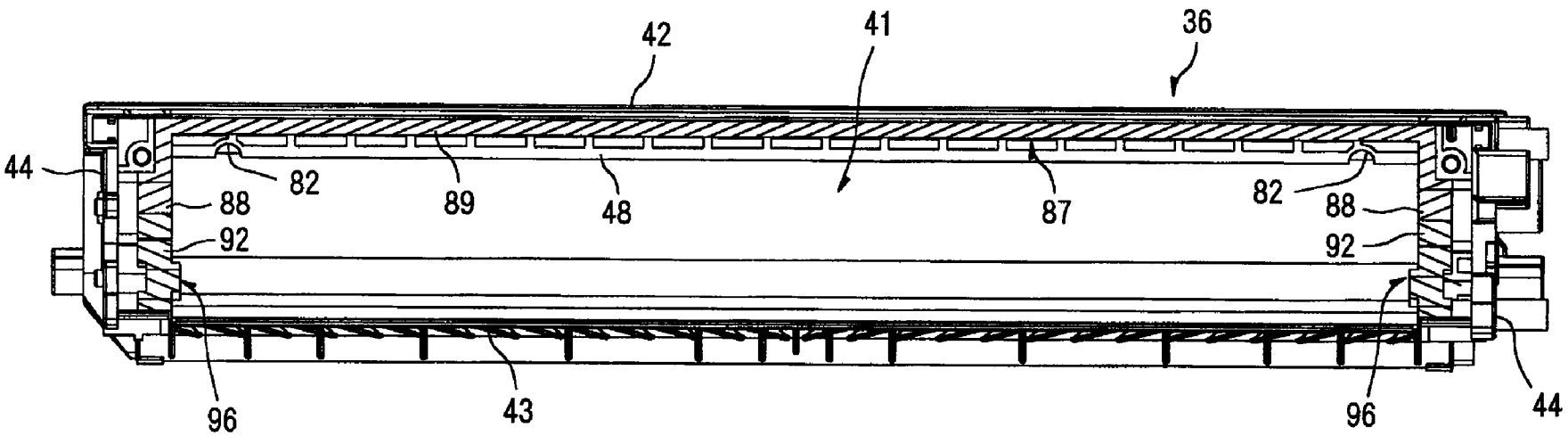
FIG. 10 is a rear view showing a state where a blade back seal and side seals are applied to the opening of the case of the developing cartridge shown in FIG. 2.
Figure 11:
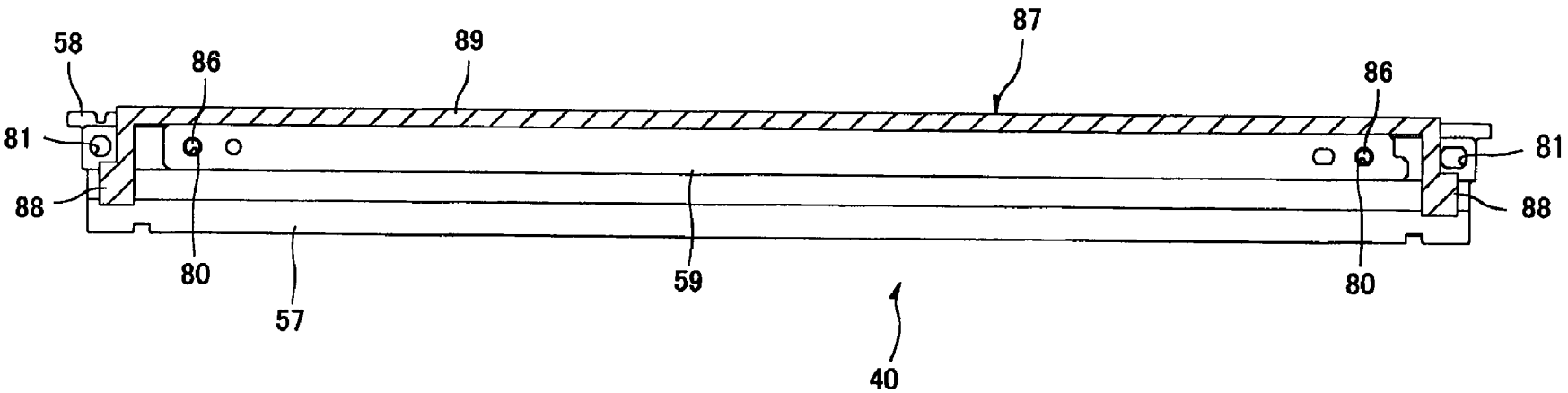
FIG. 11 is a sectional view for explaining the application position of the blade back seal and the side seals shown in FIG. 10.

The blade back seal 87 is made of sponge material such as polyurethane foam and, as shown in FIG. 10, integrally comprises the side portions 88 arranged at the upper portions of the roller opposed faces 98 of the seal arrangement portions 96 of the respective sidewalls 44 and a connecting portion 89, which extends along the upper edge of the front attachment portion 48 of the blade attachment unit 46, for connecting the side portions 88. In a state where the blade unit 40 is attached to the blade attachment unit 46, as shown in FIG. 11, the side portions 88 of the blade back seal 87 come in contact with the longitudinal (width-direction) end portions of the leaf spring member 57 respectively and the connecting portion 89 of the blade back seal 87 comes in contact with the upper end portion of the contact portion 61 of the bend preventing member 58. It is therefore possible to attach the blade unit 40 to the blade attachment unit 46 without interposing the blade back seal 87 between the reinforcing plate 59 and the front attachment portion 48 and seal arrangement portions 96 of both sidewalls 44.

Moreover, in a state before the blade unit 40 is attached to the blade attachment unit 46, the blade back seal 87 has a thickness thicker than the thickness of the reinforcing plate 59 in the anteroposterior direction (direction crossing the leaf spring member 57). When the blade unit 40 is attached to the blade attachment unit 46, the blade back seal 87 is pressed to the front attachment portion 48 of the blade attachment unit 46 and the seal arrangement portions 96 of sidewalls 44 by the leaf spring member 57 and the bend preventing member 58 and is compressed inward in the opposed direction of the leaf spring member 57 and bend preventing member 58 and the front attachment portion 48 and seal arrangement portions 96, so as to elastically press respectively the leaf spring member 57, the bend preventing member 58, the front attachment portion 48 and the seal arrangement portions 96.

Since this blade back seal 87 is provided, it is possible to seal the space between the leaf spring member 57 and the longitudinal end portions of the front attachment portion 48 by the respective side portions 88 and to seal the space between the bend preventing member 58 and the front attachment portion 48 by the connecting portion 89. It is therefore possible to prevent toner entering the back surface of the leaf spring member 57 from climbing over the upper end portion of the leaf spring member 57 from the back surface and going round to above the bend preventing member 58, and to reliably prevent leakage from between the blade unit 40 and the upper attachment portion 47 of the blade attachment unit 46.

It should be noted that the blade back seal 87 is applied to the blade attachment unit 46 and the seal arrangement portions 96 with double-sided tape before the blade unit 40 is attached to the blade attachment unit 46. For example, the blade back seal 87 can be applied to the blade attachment unit 46 and the seal arrangement portions 96 by applying one face of the double-sided tape to the blade back seal 87 and then applying the other face of the double-sided tape to the blade attachment unit 46 and the seal arrangement portions 96. At this time, when double-sided tape including polyethylene terephthalate as the medium, which has high nerve, is used, it is possible to prevent deformation (elongation) of the blade back seal 87 even when relatively large force is applied to the blade back seal 87. It is therefore possible to apply the blade back seal 87 accurately.

Moreover, as shown in FIGS. 9 and 10, this developing cartridge 26 is provided with the side seals 91 for preventing leakage of toner from the axial end portions of the developing roller 39, arranged at the lower portions of the roller opposed faces 98 of the seal arrangement portions 96 of the respective sidewalls 44.

The side seals 91 are provided so as to be frictioned with the surface of the roller 56 at the axial end portions of the roller 56 of the developing roller 39. Each of the side seals 91 comprises the sponge sealing member 92 which functions as the base and the felt sealing member 93 which functions as a friction member to be laminated on the sponge sealing member 92.

This sponge sealing member 92 extends in the vertical direction along the rotating direction of the developing roller 39 above the roller opposed face 98 of the seal arrangement portion 96, and the upper end face thereof at the downstream side in the rotating direction is connected to the lower end face of the side portion 88 of the blade back seal 87 while the lower end face thereof at the upstream side in the rotating direction is arranged to have the same face in the anteroposterior direction as a back end face 101 of the seal arrangement portion 96. Moreover, the upper end portion of the sponge sealing member 92 is arranged between the leaf spring member 57 and the seal arrangement portions 96 together with the side portion 88 of the blade back seal 87 and is interposed therebetween.

The sponge sealing member 92 is made of sponge material such as polyurethane foam, or in particular sponge material (trade name: Poron, manufactured by Rogers Inoac Corporation) having relatively high rigidity among sponge materials.

Figure 12:
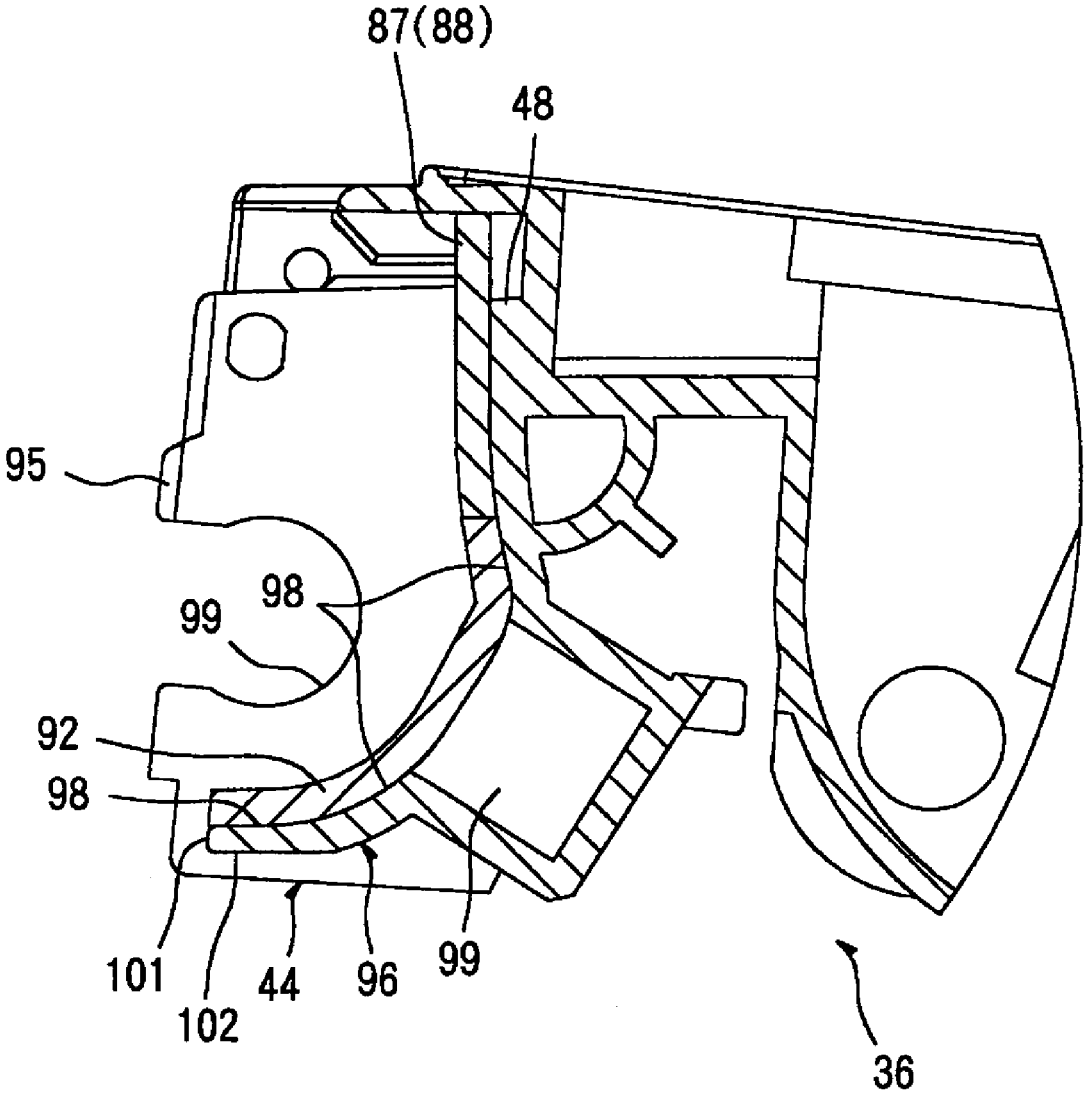
FIG. 12 is a sectional side view showing a state of the opening before the blade unit shown in FIG. 10 is attached.

Moreover, as shown in FIG. 12, the sponge sealing member 92 is formed to have a thickness equal to the thickness of the blade back seal 87 in the opposed direction of the sponge sealing member 92 and the roller 56 of the developing roller 39, in a state before the blade unit 40 is attached to the blade attachment unit 46. When the blade unit 40 is attached to the blade attachment portion 46, the sponge sealing members 92 are pressed to the seal arrangement portions 96 together with the side portions 88 of the blade back seal 87 by the longitudinal end portions of the leaf spring member 57. Furthermore, when the developing roller 39 is supported between the support plate portions 95 of the sidewalls 44 so as to be rotatable, the sponge sealing members 92 are pressed to the seal arrangement portions 96 via the felt sealing members 93 by the axial end portions of the roller 56 of the developing roller 39.

The felt sealing member 93 is made of felt constituted of polyester fiber and is formed to have the same width as the width of the sponge sealing members 92 in the width direction. Moreover, the felt sealing member 93 is formed to have a thickness thinner than the thickness of the sponge sealing members 92 in the opposed direction of the felt sealing member 93 and the developing roller 39. For example, when the thickness of the sponge sealing members 92 is set to 3.0 mm, the thickness of the felt sealing member 93 is set to 0.7 mm. This felt sealing member 93 is arranged so that the upper end portion at the downstream side in the rotating direction of the developing roller 39 extends to the lower end portion of the leaf spring member 57 and the sponge sealing member 92, extends along the sponge sealing member 92, further goes through the back end face 101 of the seal arrangement portion 96 and goes round to the lower face 102 which is the other face of the seal arrangement portion 96. A face of the felt sealing member 93 opposed to the roller 56 of the developing roller 39 is a friction face to be frictioned with the roller 56.

Figure 13:
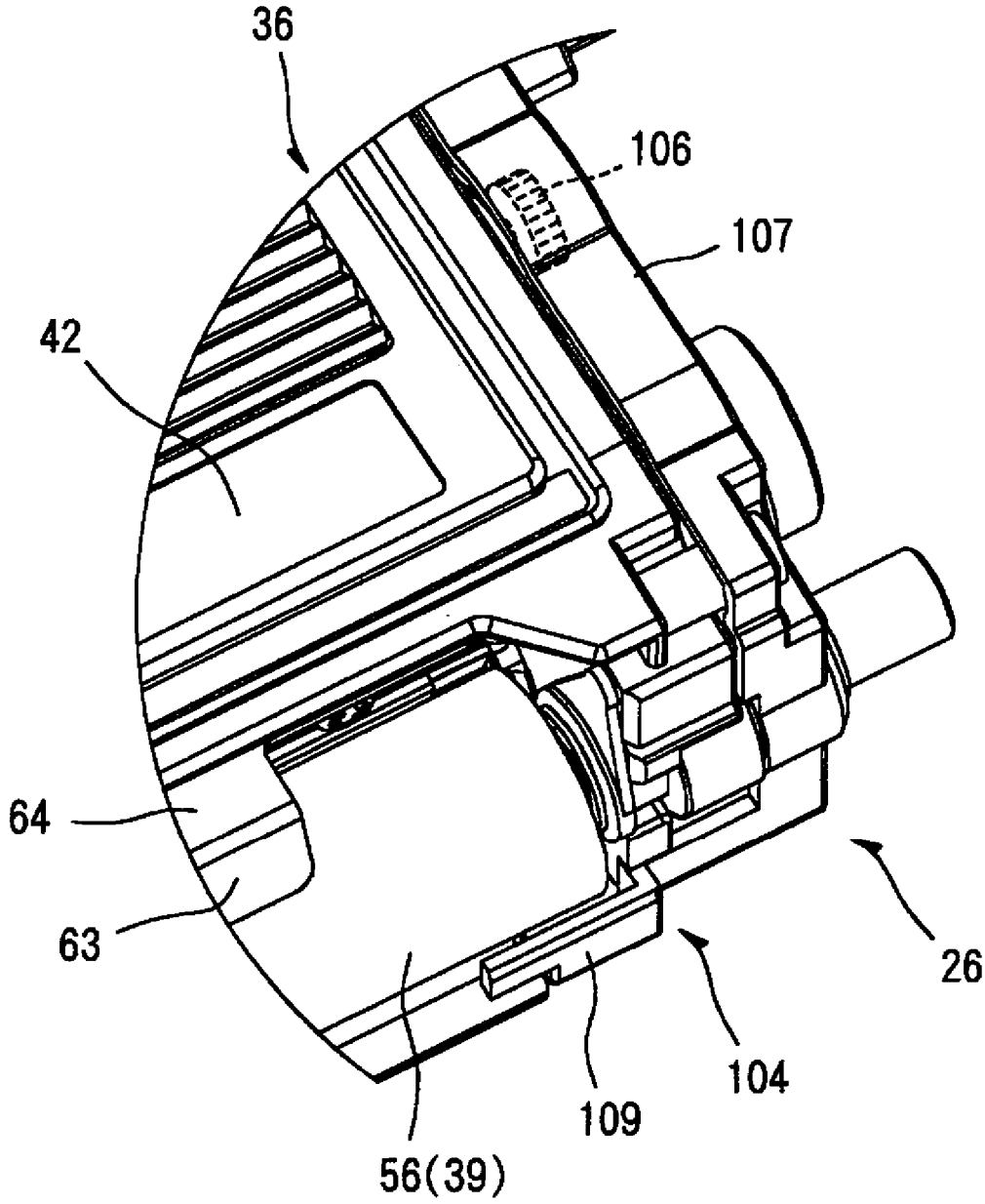
FIG. 13 is a perspective view showing the structure of a back end portion at one width-direction side of the developing cartridge shown in FIG. 2.
Figure 14:
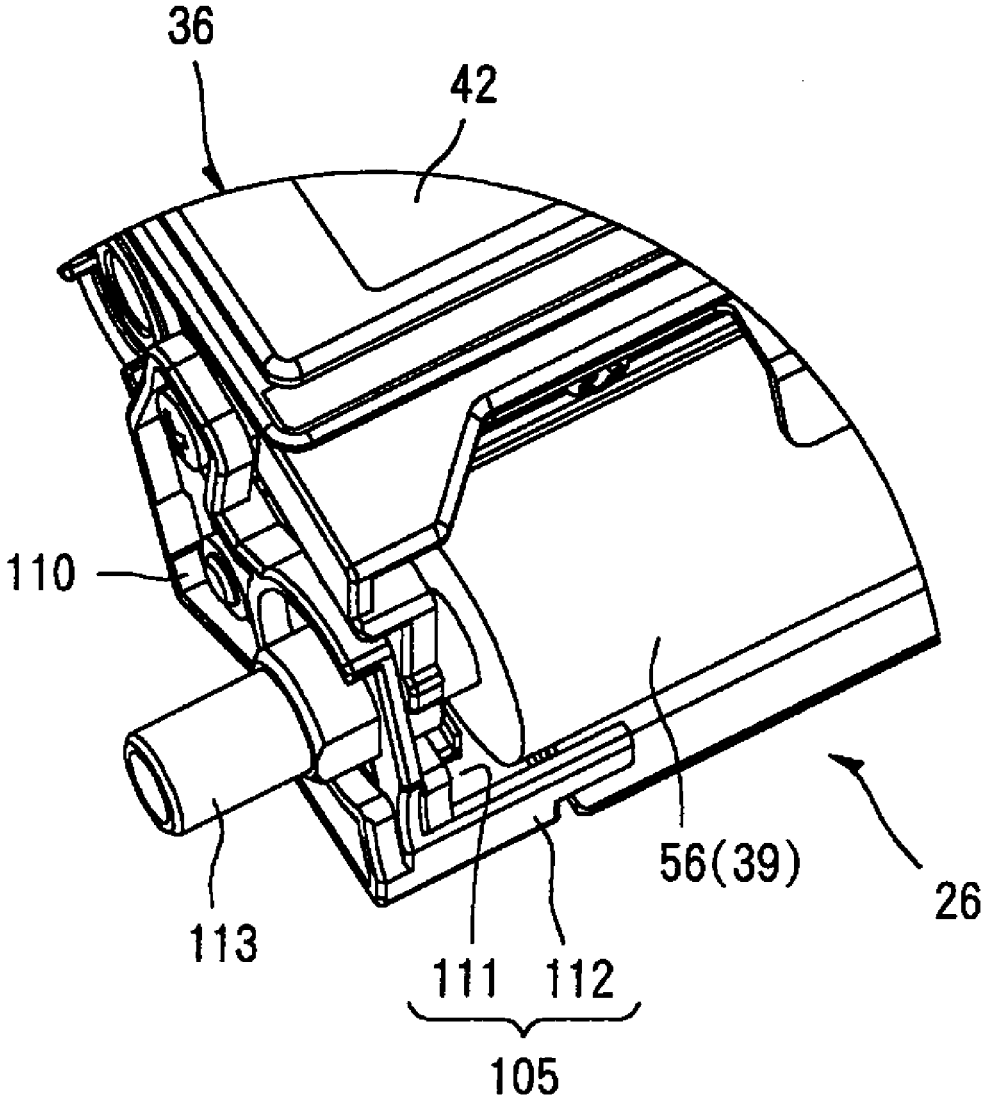
FIG. 14 is a perspective view showing the structure of a back end portion at the other width-direction side of the developing cartridge shown in FIG. 2.

As shown in FIGS. 13 and 14, receiving members 104 and 105 for receiving toner which drops from longitudinal end portions of the developing roller 39 if toner leaks from the longitudinal end portions are provided behind the seal arrangement portions 96 of the respective sidewalls 44.

Figure 15:
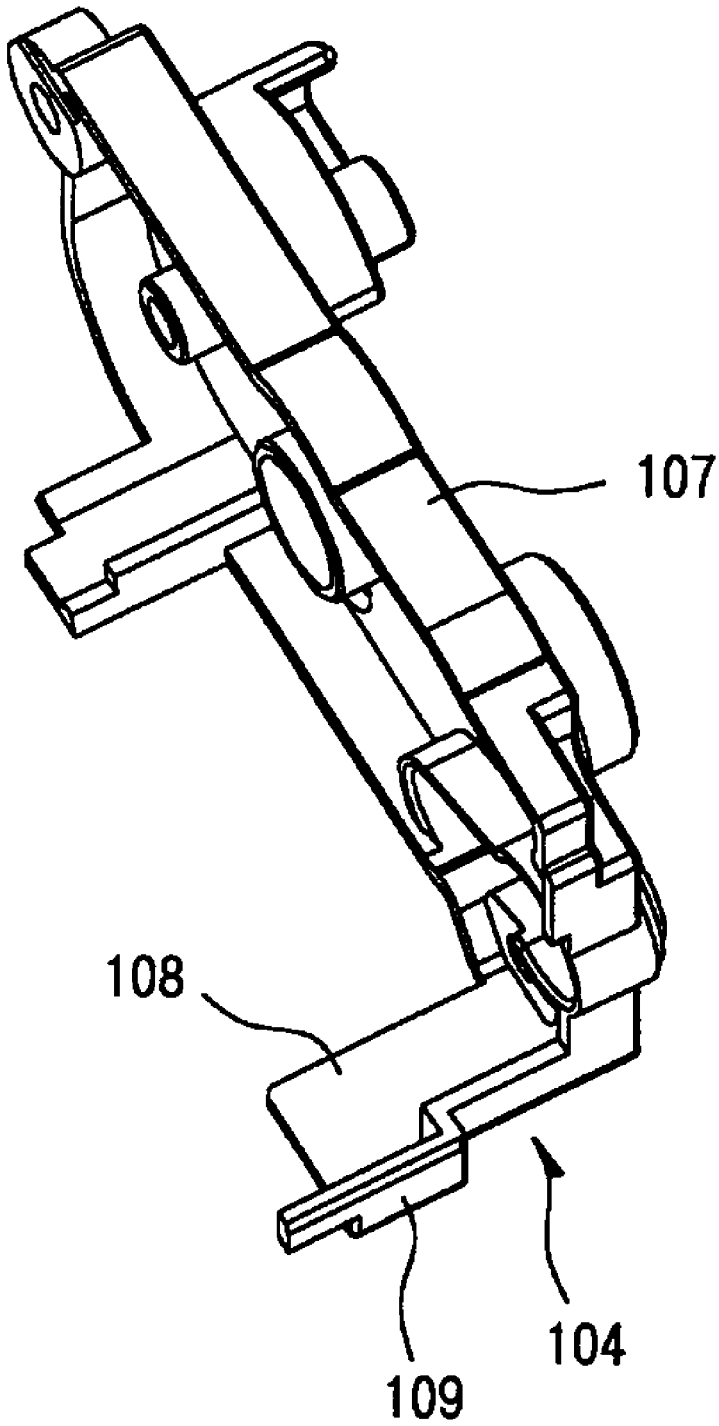
FIG. 15 is a perspective view showing the structure of a receiving member shown in FIG. 13.

As shown in FIG. 13, a gear 106 to which driving force for driving the developing roller 39 to rotate is inputted and which is provided at the axial end portion of the roller shaft 55 of the developing roller 39 is arranged outside one side wall 44, and one receiving member 104 is arranged behind the seal arrangement portion 96 of the sidewall 44 at the side where the gear 106 is provided. As shown in FIGS. 13 and 15, this receiving member 104 is formed integrally with a covering member 107 for covering the gear 106 outside the sidewall 44 so as to be freely detachable, and integrally comprises: a bottom plate portion 108 which extends horizontally from a lower edge of the back end portion of the covering member 107 inward in the width direction; and a stemming portion 109 which stands at a right angle from the back edge of this bottom plate portion 108.

Figure 16:
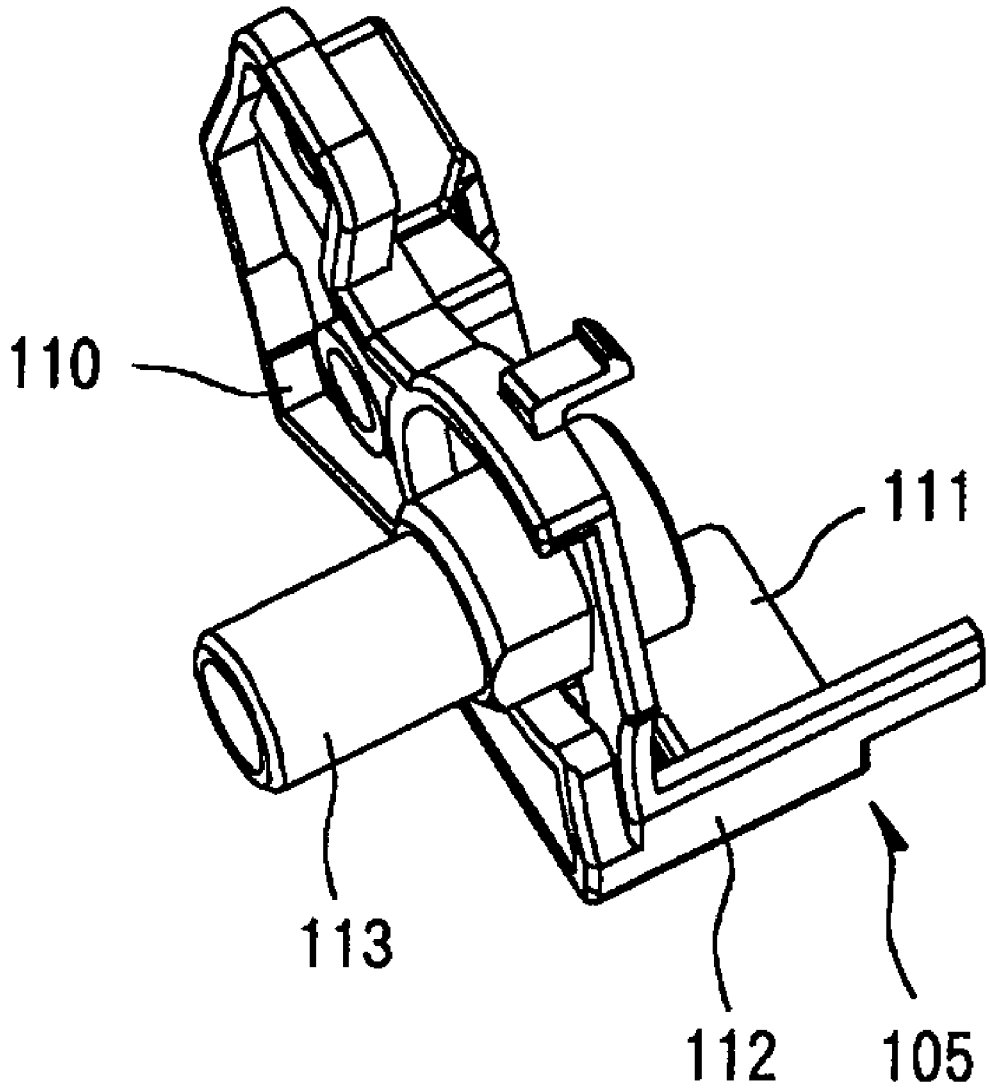
FIG. 16 is a perspective view showing the structure of a receiving member shown in FIG. 14

As shown in FIG. 14, the other receiving member 105 is arranged behind the seal arrangement portion 96 of the side wall 44 at the side opposite to the side where the gear 106 is provided. As shown in FIGS. 14 and 16, this receiving member 105 is formed integrally with a bearing member 110 for bearing the end portion of the roller shaft 55 at the side opposite to the side where the gear 106 is provided, and comprises: a bottom plate portion 111 which extends horizontally from the lower edge of the back end portion of the bearing member 110 inward in the width direction; and a stemming portion 112 which stands at a right angle from the back edge of this bottom plate portion 111. It should be noted that the bearing member 110 is provided with a cylindrical bearing cylinder portion 113, which is provided so as to be detachable with respect to the case 36 and to which the axial end portion of the roller shaft 55 is inserted, for supporting the axial end portion so as to be freely rotatable.

Moreover, as shown in FIG. 9, the bottom plate portions 108 and 111 are arranged so as to cover a portion of the felt sealing member 93, which runs round to the lower face 102 of the seal arrangement portion 96, from below.

With such a structure, since the side seals 91 are provided, it is possible to prevent leakage of toner from the axial end portions of the developing roller 39. Moreover, since the respective felt sealing member 93 is pressed elastically to the end portions of the roller 56 of the developing roller 39 by elastic force of the sponge sealing members 92 made of polyurethane foam, it is possible to reliably prevent leakage of toner from the axial end portions of the developing roller 39. Furthermore, since the respective felt sealing member 93 is made of felt, it is possible to reduce the friction resistance between the roller 56 of the developing roller 39 and the side seals 91 and to reliably prevent leakage of toner from the axial end portions of the developing roller 39.

Moreover, since only the felt sealing member 93 is arranged so as to fold back to the lower face 102 of the seal arrangement portions 96 and the sponge sealing members 92 are arranged on the roller opposed faces 98 of the seal arrangement portions 96 without folding back to the lower face 102, it is possible to reduce the trouble of arranging the sponge sealing members 92.

On the other hand, the felt sealing member 93, which is thinner than the sponge sealing members 92, can be made to fold back to the lower face 102 of the seal arrangement portions 96 from above the sponge sealing members 92 easily, and it is possible to prevent flaking of the felt sealing member 93 due to friction resistance generated in rotation of the roller 56 of the developing roller 39, by making the felt sealing member 93 to fold back to the lower face of the seal arrangement portions 96 in such a manner. As a result, it is possible to realize reliable sealing.

Furthermore, since the sponge sealing members 92 are arranged on the roller opposed faces 98 of the seal arrangement portions 96 on the basis of the back end face 101 of the seal arrangement portions 96 so that the back end face 101 and the lower end face of the sponge sealing members 92 at the upstream side in the rotating direction of the developing roller 39 have the same face in the anteroposterior direction, no step is formed by the roller opposed faces 98 and the sponge sealing members 92, and therefore it is possible to arrange the sponge sealing members 92 accurately.

It should be noted that, even when the end portion at the downstream side in the rotating direction of the sponge sealing members 92 is overlapped with the lower end portion of the side portions 88 of the blade back seal 87, it is possible to connect the sponge sealing members 92 and the side portions 88 of the blade back seal 87 without a step, by pressing the sponge sealing members 92 and the blade back seal 87 to the seal arrangement portions 96 by the longitudinal end portions of the leaf spring member 57.

Moreover, since no step is formed by the roller opposed faces 98 of the seal arrangement portions 96 and the sponge sealing members 92, it is possible to arrange the felt sealing member 93 easily and to reduce the trouble of arranging the felt sealing member 93.

Furthermore, by arranging the felt sealing member 93 along the ribs 103 formed at the width-direction end portions of the lower face of the lower wall 43, it is possible to further reduce the trouble of arranging the felt sealing member 93.

Moreover, since the receiving members 104 and 105 are provided behind the seal arrangement portions 96 of the respective sidewalls 44, it is possible to receive toner, which has leaked, by the receiving members 104 and 105 even when toner leaks from the axial end portions of the developing roller 39.

Since the receiving members 104 and 105 respectively comprise the stemming portions 109 and 112, it is possible to stem drop of the bottom plate portions 108 and 111 of toner received by the receiving members 104 and 105. It is therefore possible to prevent drop and diffusion of toner, which has been received by the receiving members 104 and 105, from the receiving members 104 and 105.

Moreover, since the bottom plate portions 108 and 111 are arranged so as to cover a portion of the felt sealing member 93 which runs round to the lower face 102 of the seal arrangement portions 96 from below, it is possible to reliably prevent flaking of the felt sealing member 93.

Furthermore, since the one receiving member 104 is formed integrally with the covering member 107, it is possible to cover the gear 106 by the covering member 107 and to attach and detach the receiving member 104 to and from the case 36. Moreover, by forming the receiving member 104 integrally with the covering member 107, it is possible to reduce the number of components of the developing cartridge 26.

Furthermore, since the other receiving member 105 is formed integrally with the bearing member 110, it is possible to attach and detach the bearing member 110 to and from the case 36 and to attach and detach the receiving member 105 to and from the case 36. Moreover, by forming the receiving member 105 integrally with the bearing member 110, it is possible to further reduce the number of components of the developing cartridge 26.

Moreover, since provided is the developing cartridge 26 capable of reducing the trouble of arranging the sponge sealing members 92 and the felt sealing member 93, it is possible to reduce the trouble of assembling the process cartridge 18 and therefore it is possible to reduce the trouble of assembling the laser printer 1.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A developing apparatus comprising:

a case having a slit-shaped opening;

a developer retainer which has a cylindrical shape, is supported by the case so as to be rotatable, and is arranged such that an axial direction thereof is along a longitudinal direction of the opening;

a rectangular leaf spring, which has a sheet-like shape, is arranged in a longitudinal direction of the developer retainer and has one side end portion in a direction of a shorter side thereof that is fastened to the case;

a pressing member which is arranged at the other side end portion in the direction of the shorter side of the leaf spring, for pressing the developer retainer by the leaf spring;

a blade back seal which is interposed between the case and the leaf spring;

a sponge sealing member which is interposed between the case and the developer retainer, and between the case and the leaf spring, wherein the blade back seal is in contact with the sponge sealing member between the one side end portion and the other side end portion of the leaf spring, and wherein the blade back seal and the sponge sealing member which are interposed between the case and the leaf spring, have the same thickness.

2. The developing apparatus according to claim 1, wherein the blade back seal and the sponge sealing member are made of polyurethane foam.

3. The developing apparatus according to claim 1, further comprising a holding chamber which is arranged in the case, for holding developer.

4. The developing apparatus according to claim 1, further comprising a friction member which is arranged along the sponge sealing member between the developer retainer and the sponge sealing member, wherein the friction member is made of felt, and both ends in a longitudinal direction of the leaf spring are interposed between the blade back seal and the friction member.

5. A developing apparatus comprising:

a case having a slit-shaped opening;

a developer retainer which has a cylindrical shape, is supported by the case so as to be rotatable, and is arranged such that an axial direction thereof is along a longitudinal direction of the opening;

a rectangular leaf spring, which has a sheet-like shape, is arranged in a longitudinal direction of the developer retainer and has one side end portion in a direction of a shorter side thereof that is fastened to the case;

a pressing member which is arranged at the other side end portion in the direction of the shorter side of the leaf spring, for pressing the developer retainer by the leaf spring;

a blade back seal which is interposed between the case and the leaf spring;

a sponge sealing member which is interposed between the case and the developer retainer, and between the case and the leaf spring, wherein the blade back seal is in contact with the sponge sealing member between the one side end portion and the other side end portion of the leaf spring, and wherein the blade back seal and the sponge sealing member have the same thickness at their point of contact.

6. The developing apparatus according to claim 5, wherein the blade back seal and the sponge sealing member are made of polyurethane foam.

7. The developing apparatus according to claim 5, further comprising a holding chamber which is arranged in the case, for holding developer.

8. The developing apparatus according to claim 5, further comprising a friction member arranged along the sponge sealing member between the developer retainer and the sponge sealing member, wherein the friction member is made of felt, and both ends in a longitudinal direction of the leaf spring are interposed between blade back seal and the friction member.

* * * * *